US007591227B2

(12) United States Patent
Landoni

(10) Patent No.: US 7,591,227 B2
(45) Date of Patent: Sep. 22, 2009

(54) SYSTEMS AND METHODS FOR THREAD HANDLING AND/OR CUTTING

(76) Inventor: Alberto Landoni, 3 Strada Prov. Busto, Cassano n. 3, P.O. Box n.60, 21054 Fagnano Olona (VA) (IT)

( * ) Notice: Subject to any disclaimer, the term of this patent is extended or adjusted under 35 U.S.C. 154(b) by 0 days.

(21) Appl. No.: 12/048,943

(22) Filed: Mar. 14, 2008

(65) Prior Publication Data

US 2009/0126611 A1 May 21, 2009

Related U.S. Application Data

(60) Provisional application No. 60/989,174, filed on Nov. 20, 2007.

(51) Int. Cl.
*D05B 65/00* (2006.01)
*D05B 57/26* (2006.01)

(52) U.S. Cl. ..... 112/475.17; 112/291; 83/229

(58) Field of Classification Search ..... 112/181–201, 112/228, 230, 231, 285, 291–298, 475.01; 83/27, 220, 229, 910
See application file for complete search history.

(56) References Cited

U.S. PATENT DOCUMENTS 1,883,654 A * 10/1932 Ericsson ..... 112/296
3,141,432 A * 7/1964 Reeber et al. ..... 112/292
3,173,392 A * 3/1965 Hedegaard ..... 112/292
3,512,491 A * 5/1970 Strothmann et al. ..... 112/292
3,728,978 A * 4/1973 Honda et al. ..... 112/292
3,783,813 A 1/1974 Kroll
3,888,198 A 6/1975 Bauer et al.
3,894,502 A 7/1975 Hager et al.
3,924,554 A 12/1975 Cummins
4,123,986 A 11/1978 Konersmann
4,515,099 A 5/1985 Creed
5,375,546 A * 12/1994 Butzen et al. ..... 112/292
5,881,659 A 3/1999 Sato
5,921,192 A * 7/1999 Badillo ..... 112/231

OTHER PUBLICATIONS

"Component Parts Chart", found at http://hirose.s-club.net/en/chart.htm printed Oct. 3, 2007 (1 page).
"Types of Hook Gib", found at http://hirose.s-club.net/en/hook.htm printed Oct. 3, 2007 (2 pages).
International Search Report dated Mar. 16, 2009.

* cited by examiner

*Primary Examiner*—Ismael Izaguirre
(74) *Attorney, Agent, or Firm*—Greenberg Traurig, LLP

(57) ABSTRACT

One embodiment of the present invention relates to a system for thread handling (e.g., separating) and/or cutting. Another embodiment of the present invention relates to a method for thread handling (e.g., separating) and/or cutting. In one example, the present invention may be used in connection with sewing machines, embroidery machines, quilting machines and the like.

3 Claims, 14 Drawing Sheets

SYSTEMS AND METHODS FOR THREAD HANDLING AND/OR CUTTING

RELATED APPLICATIONS

This application claims the benefit of U.S. Provisional Application Ser. No. 60/989,174, filed Nov. 20, 2007. The aforementioned application is incorporated herein by reference in its entirety.

FIELD OF THE INVENTION

One embodiment of the present invention relates to a system for thread handling (e.g., separating) and/or cutting.

Another embodiment of the present invention relates to a method for thread handling (e.g., separating) and/or cutting.

In one example, the present invention may be used in connection with sewing machines, embroidery machines, quilting machines and the like.

BACKGROUND OF THE INVENTION

FIG. 1 shows a component parts chart of various sewing machine related components (FIG. 1 was printed Oct. 3, 2007 from http://hirose.s-club.net/en/chart.htm).

FIG. 2 shows types of hook gibs for sewing machines (FIG. 2 was printed Oct. 3, 2007 from http://hirose.s-club.net/en/hook.htm).

With reference to FIG. 2 in particular, it is noted that the so-called A-TYPE (Short gib) is said to be for sewing heavy material and zigzag sewing. This type of short gib is said to not keep the needle thread for as long a time as some other types of gibs and therefore does not cause trouble in connection with the thread passing (even if the hook is set at a rather late time against the needle).

Still referring to FIG. 2, it is noted that the so-called B-TYPE (Full gib) is said to be for general use and permits sewing from light to heavy materials. This type's special feature is said to be a long-extending gib, which serves to prevent excessive thread-loosening since it holds the needle thread for a relatively long time when it passes out from the hook. It is therefore said to be effective at preventing looping (the towel texture formed on the back of a cloth), which is apt to appear when strongly twisted or rough thread is used.

Still referring to FIG. 2, it is noted that the so-called C-TYPE (Tacking gib) is said to be used for medium and light materials. It has a projection to prevent the needle thread from entering into a gap between the race way of the hook and the race of the bobbin case holder when it is passing through. This projection is said to keep the thread on itself and not only prevents the thread jamming, but also lessens an unnecessary thread loosening to a certain degree by holding the thread.

Furthermore, due to this projection, the race way of the hook is extended in length, which is effective to increase durability and reduce its noise.

Still referring to FIG. 2, it is noted that the so-called D-TYPE gib is said to be designed for sewing light materials (this type of gib is said to have the advantages of both B-type and C-type.) Namely, it has a gib like B-type's for holding the thread and a projection like C-type's to prevent thread jamming. Another feature on D-type is the lightness of the bobbin case holder, which is said to reduce its moment of inertia and lessen the resistant force that occurs when the thread passes through the position bracket (finger) of the bobbin case holder. This is said to ensure smooth sewing when using a fine or weak thread, or a synthetic fiber thread which is difficult to handle.

Still referring to FIG. 2, it is noted that the so-called BOH-TYPE gib is said to be for sewing medium and heavy materials. The gib is said to be comparatively short in length to ensure smooth thread-passing and to prevent looping (even when loosely-twisted, thick and soft thread is used).

Still referring to FIG. 2, it is noted that the so-called F-TYPE (Jamproof gib) is said to belong to the A-type. This type features a gib set on the hook body with stud screws and coil spring (jam proof). When jamming occurs, this structure is said to allow the thread to be taken away from the race without disassembling the rotating hook. This type is also said to be available for zigzag sewing for house-hold sewing machines.

BRIEF DESCRIPTION OF THE DRAWINGS

(FIG. 3A is a perspective view from the side of the bobbin; FIG. 3B is a front view from the side of the bobbin; and FIGS. 3C-3F are profile/top-bottom views corresponding to FIG. 3B);

(FIG. 4A is a perspective view from the side of the bobbin; FIG. 4B is a front view from the side of the bobbin; and FIGS. 4C-4F are profile/top-bottom views corresponding to FIG. 4B);

(FIG. 5A is a perspective view from the side of the bobbin; FIG. 5B is a front view from the side of the bobbin; and FIGS. 5C-5F are profile/top-bottom views corresponding to FIG. 5B); (FIG. 6A is a perspective view from the side of the bobbin; FIG. 6B is a front view from the side of the bobbin; and FIGS. 6C-6F are profile/top-bottom views corresponding to FIG. 6B).

Figure 1:
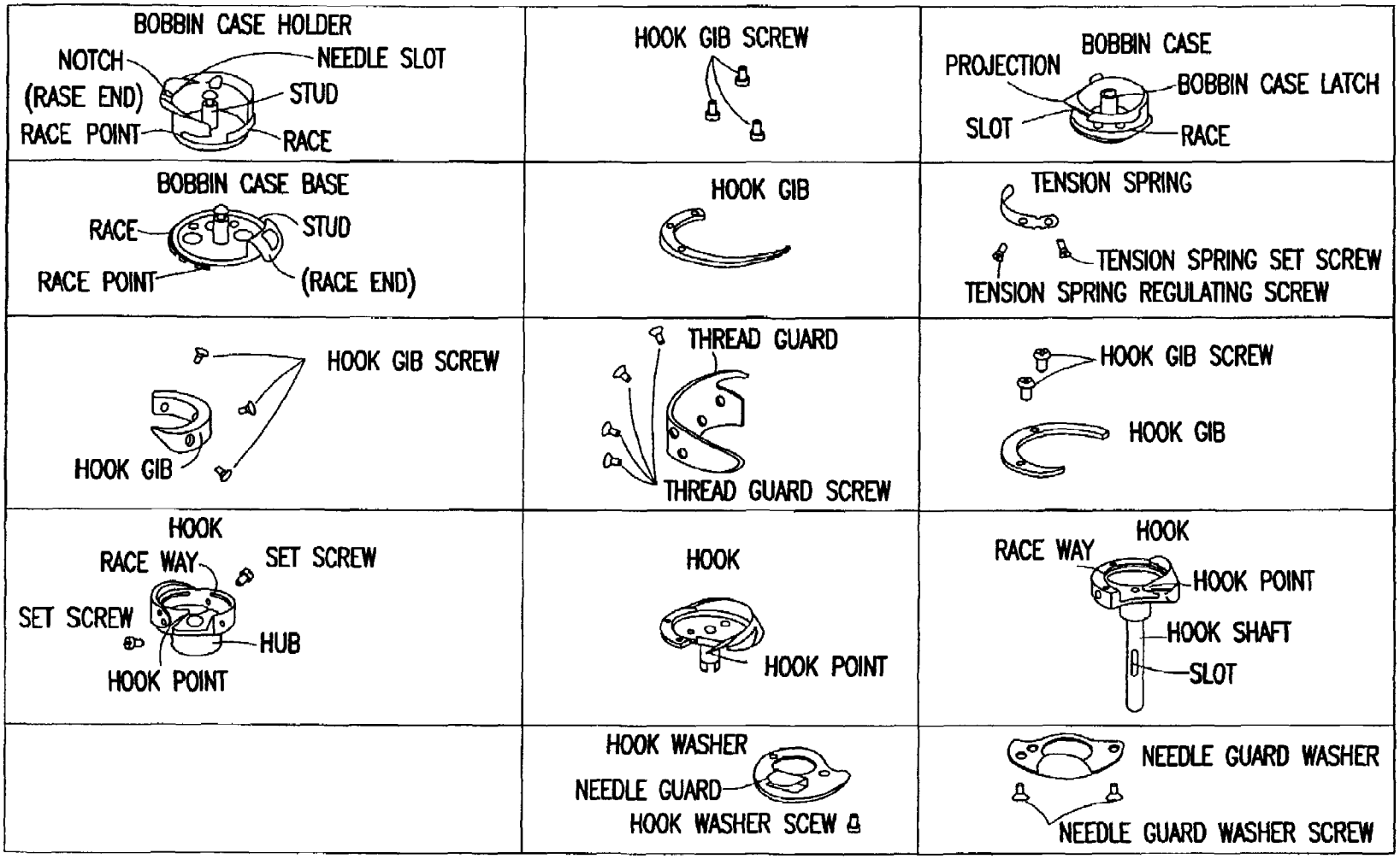
FIG. 1 shows a component parts chart of various sewing machine related components (FIG. 1 was printed Oct. 3, 2007 from http://hirose.s-club.net/en/chart.htm)
Figure 2:
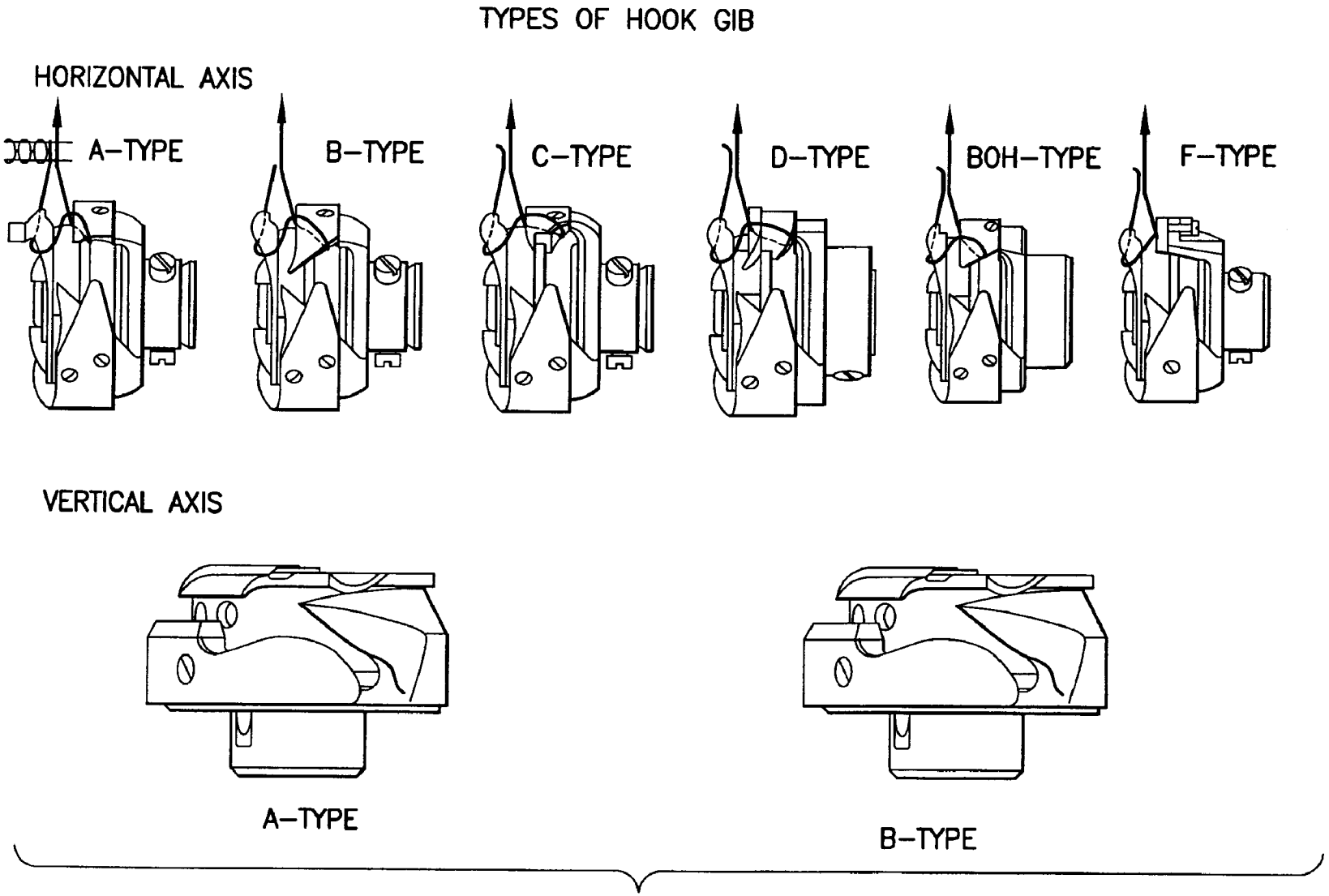
FIG. 2 shows types of hook gibs for sewing machines (FIG. 2 was printed Oct. 3, 2007 from http://hirose.s-club.net/en/hook.htm)

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, any figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, a method of cutting thread is provided, comprising: rotating through an angle of greater than 360 degrees a rotary hook assembly in a forward direction to make a lock stitch formed by a top thread and a bottom thread, wherein at least one component is attached to or integral with the rotary hook assembly; stopping the rotation of the rotary hook assembly; and rotating the rotary hook assembly in a reverse direction so as to cut at least a portion of at least one of the top thread and the bottom thread, wherein the cut is made by the component having at least one blade.

In another embodiment, a method of cutting thread is provided, comprising: rotating through an angle of greater than 360 degrees a rotary hook assembly to make a lock stitch formed by a top thread and a bottom thread, wherein at least one component is attached to or integral with the rotary hook assembly and wherein the component rotates with the rotary hook assembly; separating a first portion of the top thread from a second portion of the top thread using the component; and cutting at least a portion of at least one of the top thread and the bottom thread with a cutting blade contacted to at least a part of a surface of the component.

In another embodiment, a method of cutting thread is provided, comprising: rotating through an angle of greater than 360 degrees a rotary hook assembly to make a lock stitch formed by a top thread and a bottom thread, wherein at least one component is attached to or integral with the rotary hook assembly and wherein the component rotates with the rotary hook assembly; separating a first portion of the top thread from a second portion of the top thread using a cutting blade; and cutting at least a portion of at least one of the top thread and the bottom thread with the cutting blade contacted against at least part of a surface of the component.

In another embodiment, an assembly is provided, comprising: a rotary hook; a component attached to or integral with the rotary hook, wherein the component is capable of rotating with the rotary hook, wherein the rotary hook is capable of assisting in making a lock stitch formed by a top thread and a bottom thread, and wherein the component is capable of separating a first portion of the top thread from a second portion of the top thread; and a cutting blade capable of cutting at least a portion of at least one of the top thread and the bottom thread when the cutting blade is contacted to at least a part of a surface of the component.

In another embodiment, an assembly for sewing a lock stitch is provided, comprising: a rotary hook capable of rotating through an angle of greater than 360 degrees; and a component attached to or integral with the rotary hook; wherein the component is capable of rotating with the rotary hook; wherein the rotary hook is capable of assisting in making a lock stitch formed by a top thread and a bottom thread; and wherein the component is capable of cutting at least a portion of at least one of the top thread and the bottom thread.

In one example, the component may comprise a hook.

In another example, the component may comprise a thread guard.

In another example, the component may comprise a hook gib.

In another example, the rotation in the reverse direction may be through an angle of less than 360 degrees.

In another example, the rotation in the reverse direction may be through an angle of between 30 to 180 degrees.

In one example, the method may further comprise stopping the rotation of the rotary hook assembly and then cutting.

In another example, the cutting may be done with the cutting blade and a cutting feature attached to or integral with the component.

In another example, the component may be capable of cutting at least a portion of the top thread and at least a portion of the bottom thread.

In another example, a bobbin in the rotary hook may remain essentially stationary.

Figure 3A:
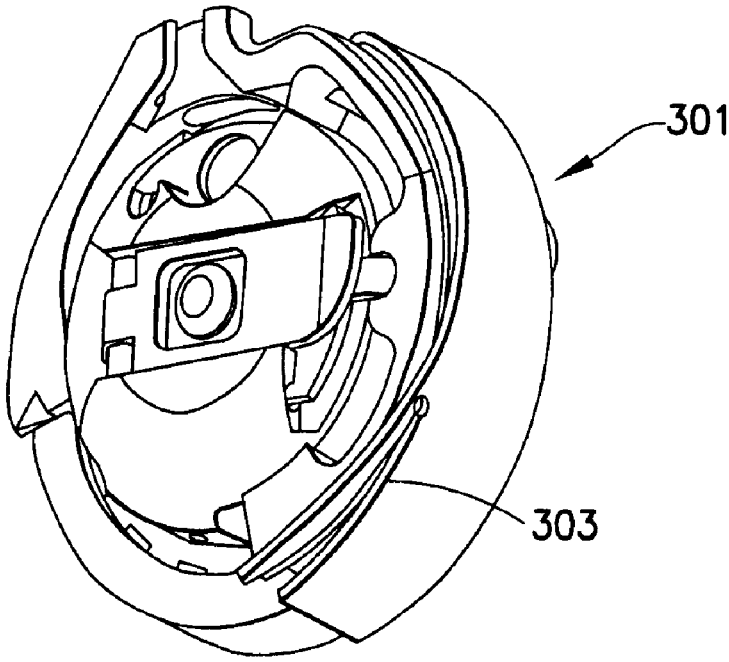
FIGS. 3A-3F show one example device for thread handling (e.g., separating) and/or cutting according to the present invention
Figure 3B:
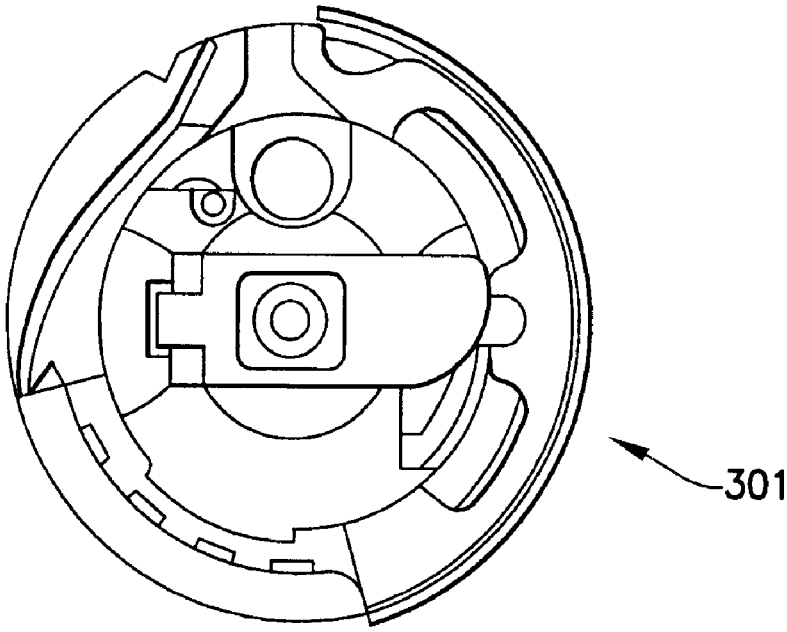
Figure 3C:
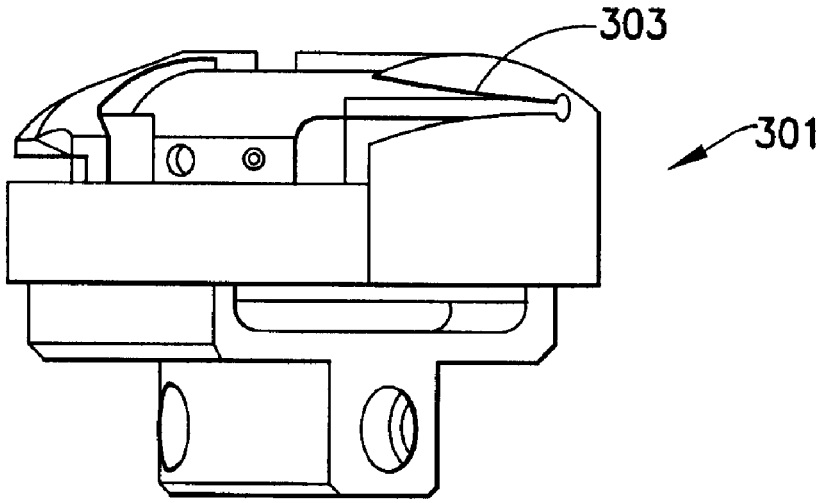
Figure 3D:
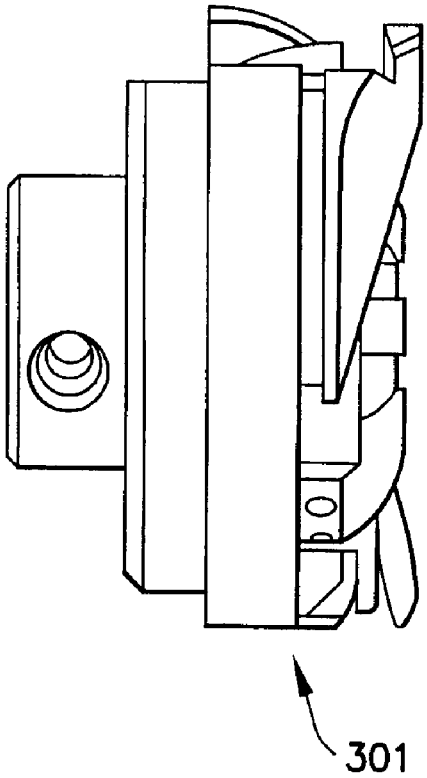
Figure 3E:
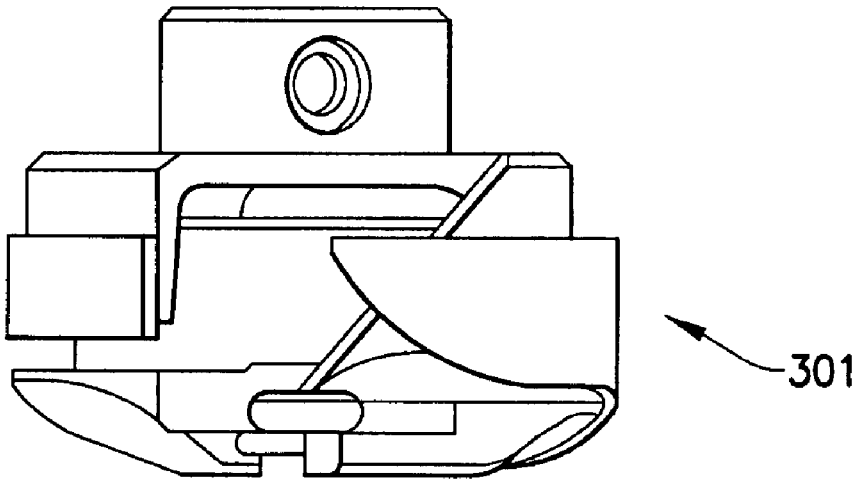
Figure 3F:
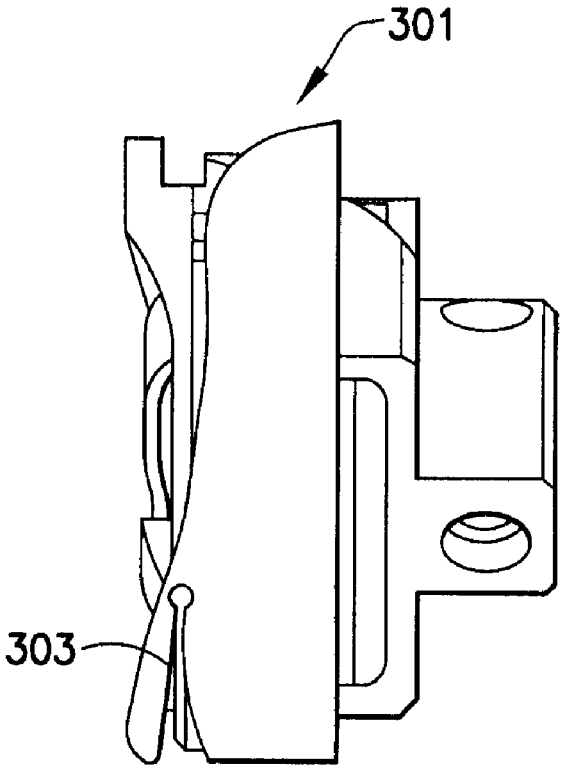

Referring now to FIGS. 3A-3F, details of one example device for thread handling (e.g., separating) and/or cutting according to the present invention are shown. More particularly, it is seen that rotary hook assembly 301 may include blade 303 for cutting thread as described herein (e.g., when blade 303 is rotated in a reverse direction).

Figure 4A:
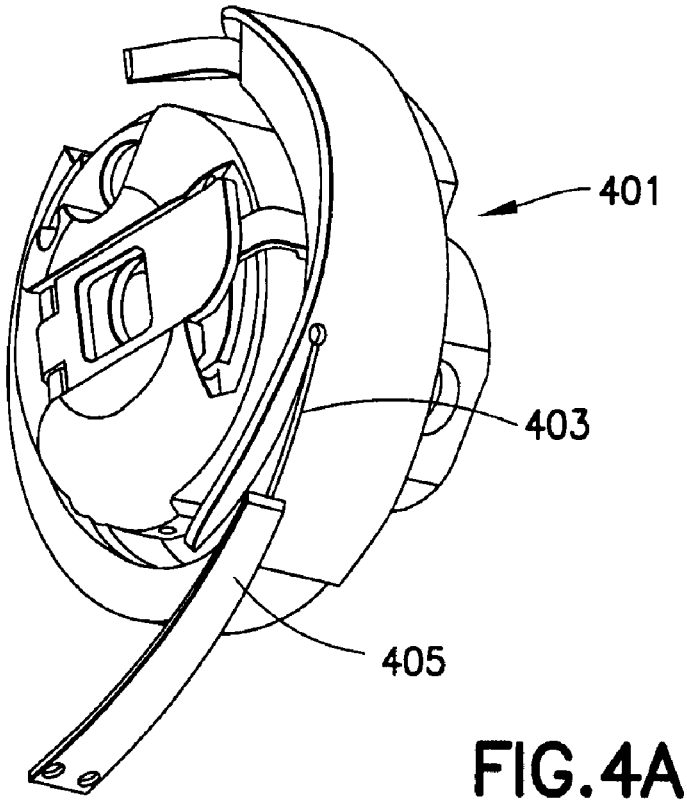
FIGS. 4A-4F show another example device for thread handling (e.g., separating) and/or cutting according to the present invention
Figure 4B:
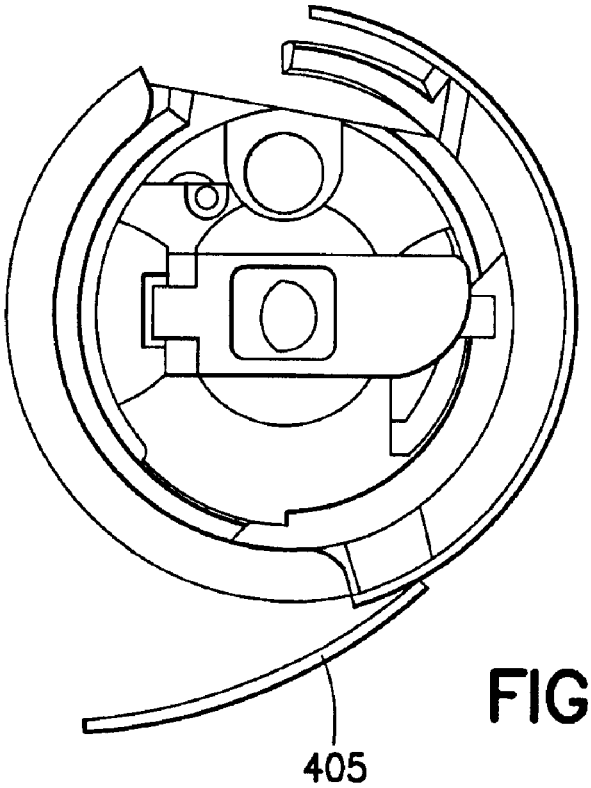
Figure 4C:
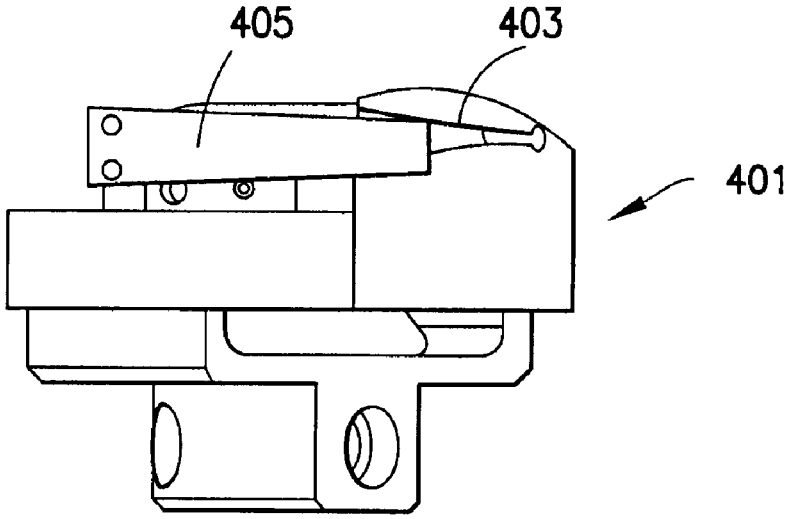
Figure 4D:
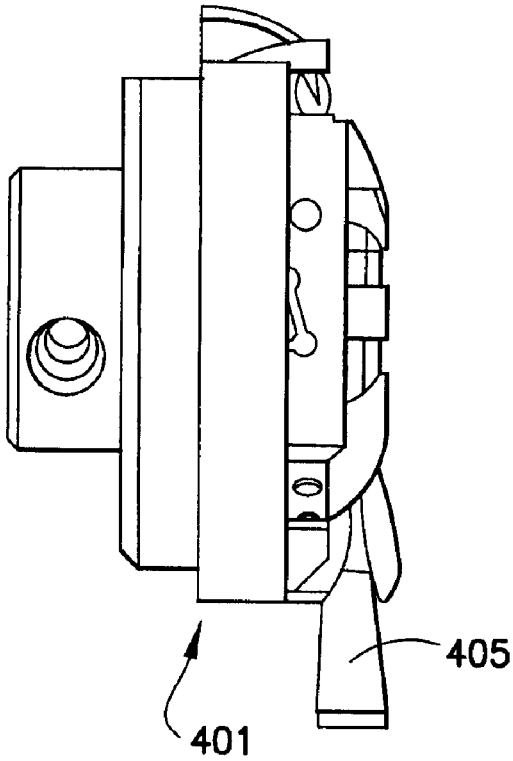
Figure 4E:
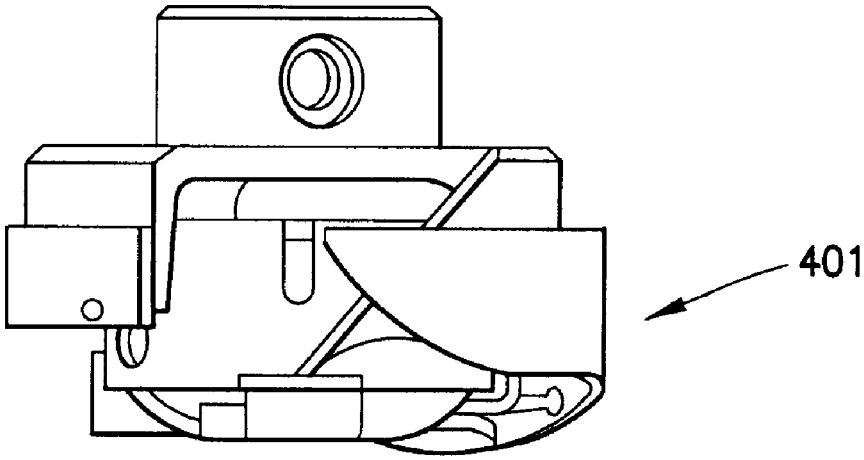
Figure 4F:
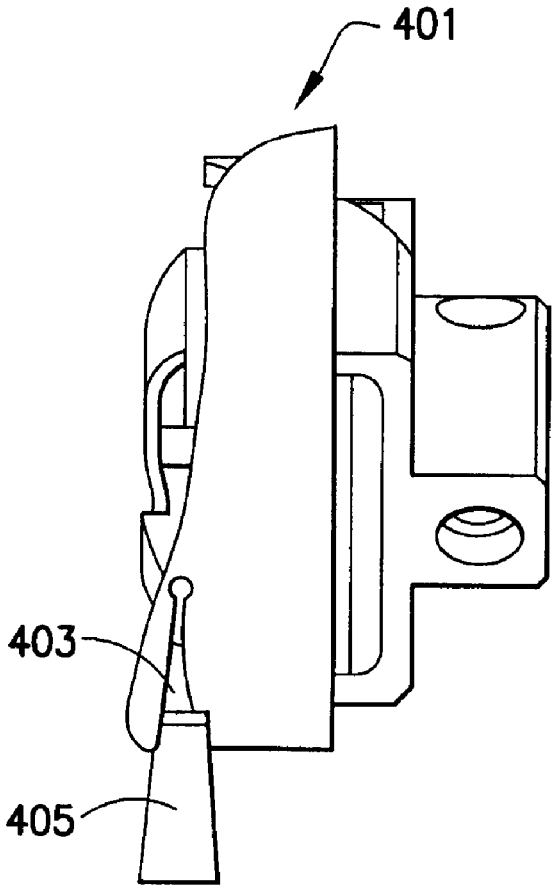

Referring now to FIGS. 4A-4F, details of another example device for thread handling (e.g., separating) and/or cutting according to the present invention are shown. More particularly, it is seen that rotary hook assembly 401 may include blade 403 cooperating with contra blade 405 for cutting thread as described herein (e.g., when blade 403 is rotated in a reverse direction and contra blade 405 is brought into contact with rotary hook assembly 401).

Figure 5A:
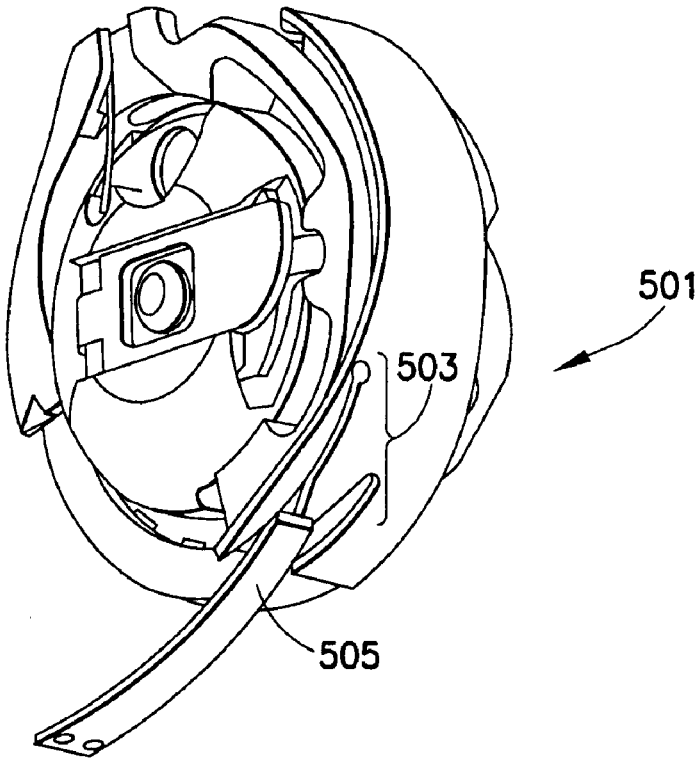
FIGS. 5A-5F show another example device for thread handling (e.g., separating) and/or cutting according to the present invention
Figure 5B:
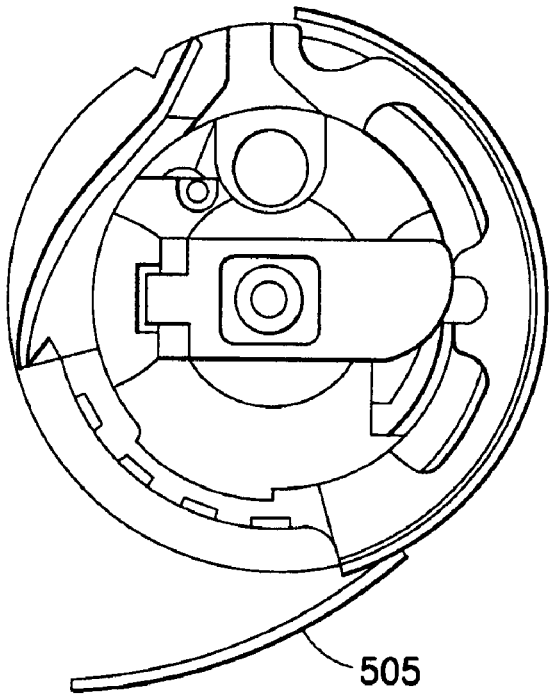
Figure 5C:
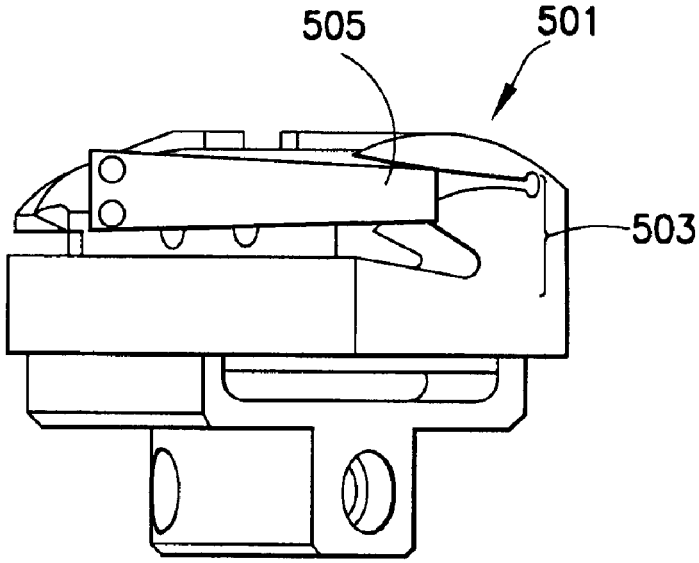
Figure 5D:
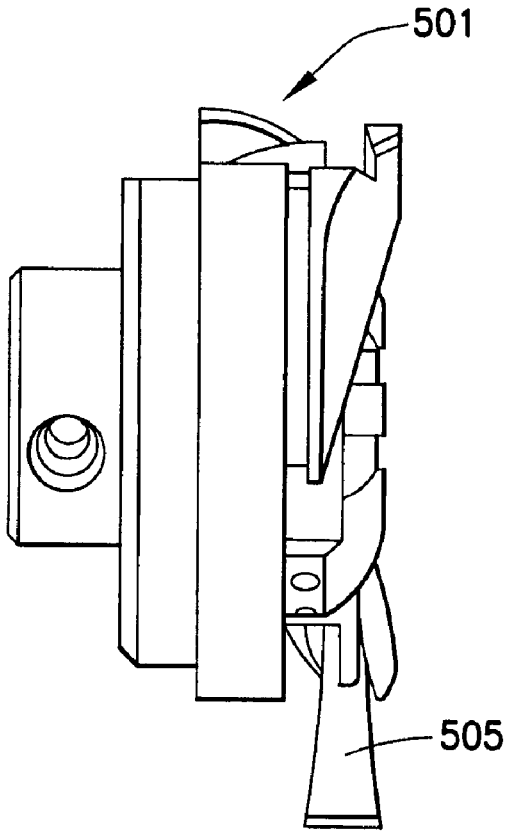
Figure 5E:
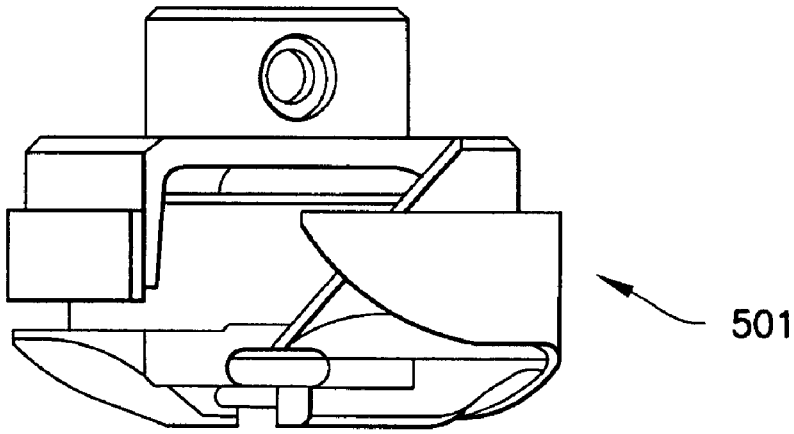
Figure 5F:
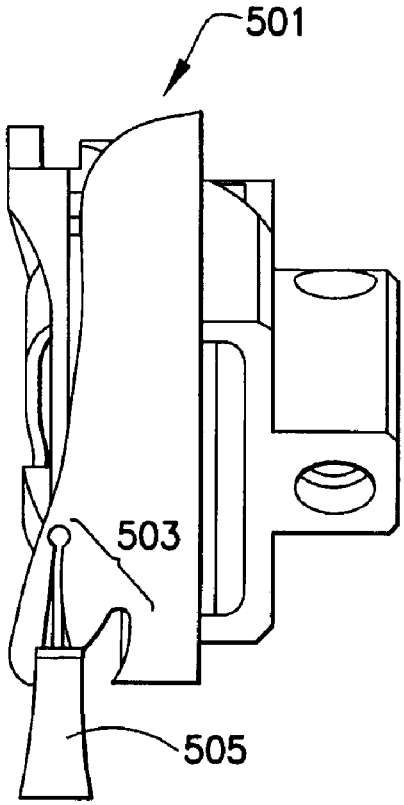

Referring now to FIGS. 5A-5F, details of another example device for thread handling (e.g., separating) and/or cutting according to the present invention are shown. More particularly, it is seen that rotary hook assembly 501 may include thread separator/blade 503 cooperating with contra blade 505 for separating/cutting thread as described herein (e.g., when separator/blade 503 is rotated in a reverse direction to separate threads and contra blade 505 is brought into contact with rotary hook assembly 501 to cooperate with separator/blade 503 to cut thread).

Figure 6A:
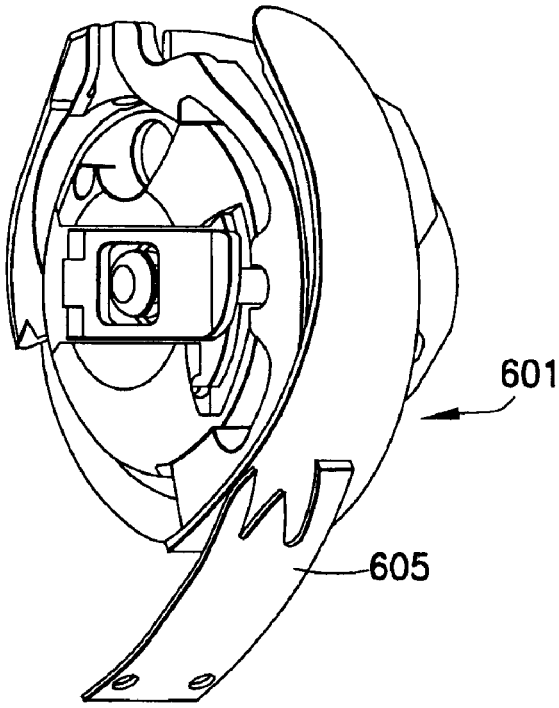
FIGS. 6A-6F show another example device for thread handling (e.g., separating) and/or cutting according to the present invention
Figure 6B:
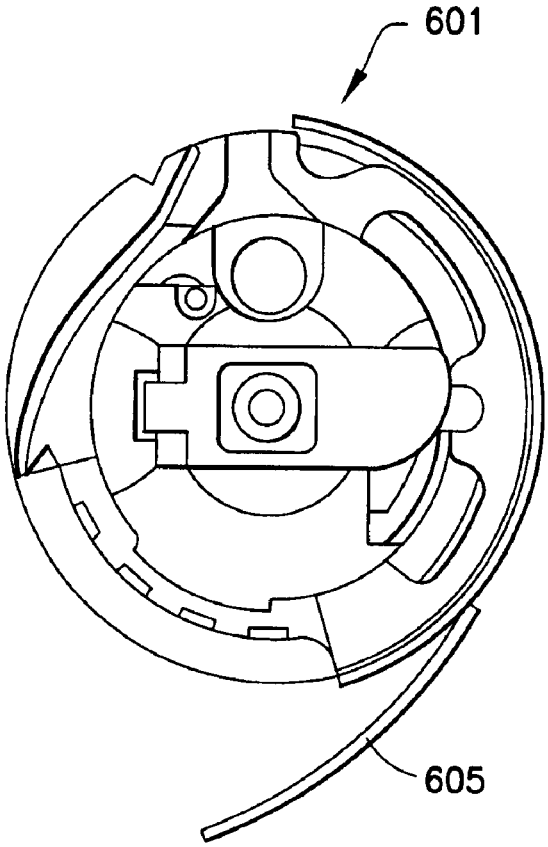
Figure 6C:
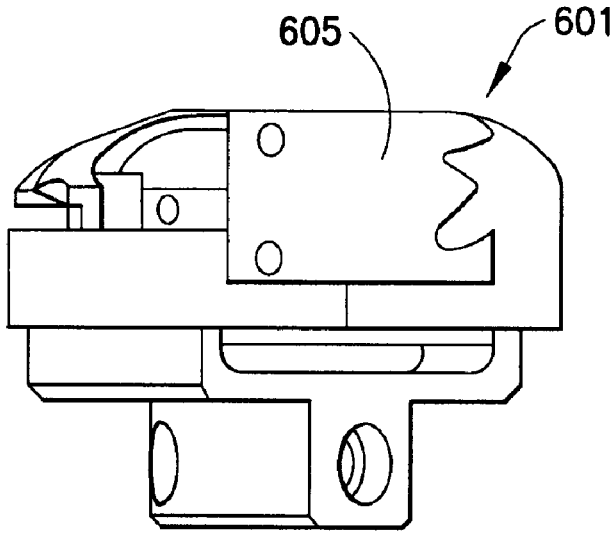
Figure 6D:
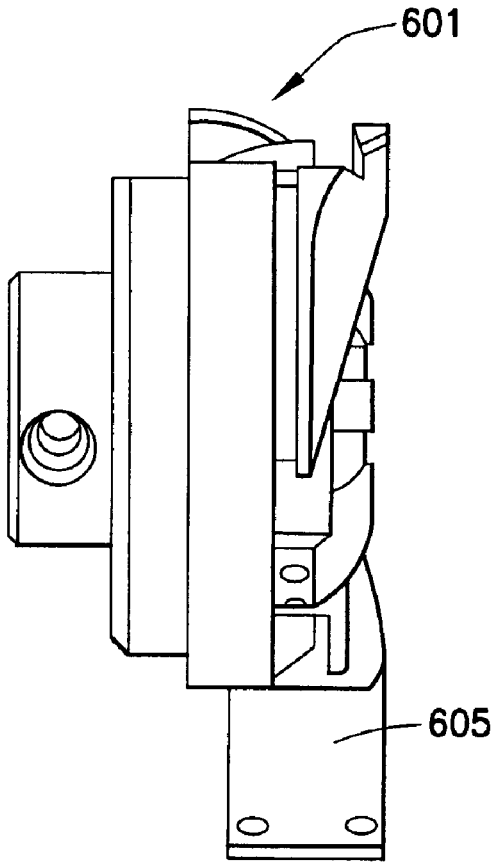
Figure 6E:
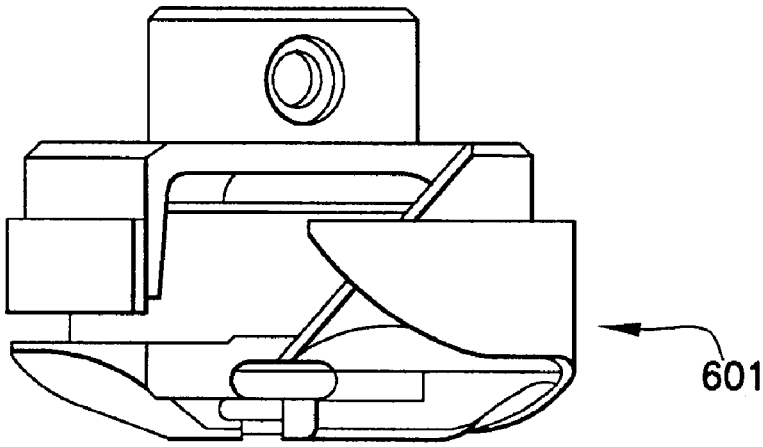
Figure 6F:
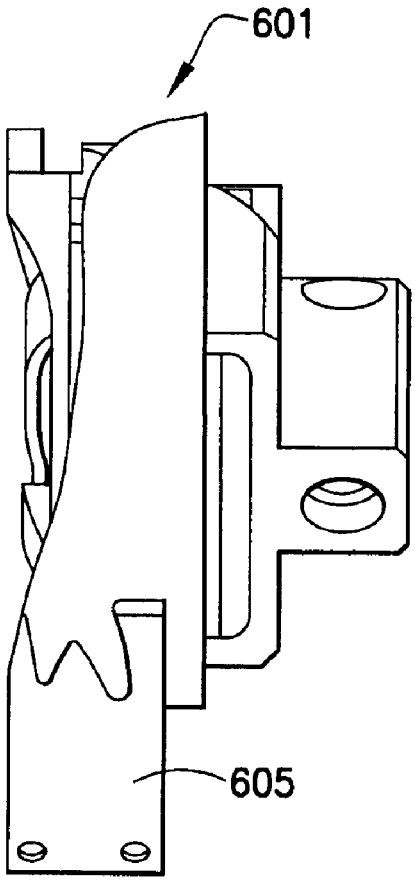

Referring now to FIGS. 6A-6F, details of another example device for thread handling (e.g., separating) and/or cutting according to the present invention are shown. More particularly, it is seen that this example device may include thread separator/blade 605 for separating/cutting thread as described herein (e.g., when separator/blade 605 is brought into contact with rotary hook assembly 601 to separate/cut thread).

As described herein, various embodiments of the present invention may provide for reverse rotation of a rotary hook to separate and/or cut thread (e.g. a top thread and/or bottom thread). In one example, such reverse rotation of the rotary hook may be via a linear actuator (e.g., a linear actuating cylinder). In another example, such linear actuator may move the rotary hook after the rotary hook has been decoupled from a driving motor or gearbox system.

Further, as described herein, various embodiments of the present invention may provide for integrating one or more thread separating elements and/or cutting blades into a rotary hook (wherein the one or more thread separating elements and/or cutting blades rotate with the rotary hook).

Further still, as described herein, various embodiments of the present invention may provide for placing one or more thread separating elements and/or cutting blades adjacent (e.g., touching or almost touching) a rotary hook. In one example, the one or more thread separating elements and/or cutting blades do not rotate with the rotary hook—such thread separating elements and/or cutting blades may be in a stationery position relative to the rotary hook and/or may be mounted such that the thread separating elements and/or cutting blades move towards/away from the rotary hook. In another example, such thread separating elements and/or cutting blades may be moved towards/away from the rotary hook while the rotary hook is stationary. In another example, such thread separating elements and/or cutting blades may be moved towards/away from the rotary hook while the rotary hook is rotating. In another example, such thread separating elements and/or cutting blades may be moved towards/away from the rotary hook via a linear actuator (e.g., a linear actuating cylinder).

In another example, one rotary hook may be utilized.

In another example, a plurality of rotary hooks may be utilized. In another example, a single motor may be used to drive all of the plurality of rotary hooks (e.g., in a one-to-many correspondence). In another example, each of the plurality of rotary hooks may be driven by an individual motor (e.g., in a one-to-one correspondence). In another example, all of the plurality of rotary hooks may be driven by the same motor that drives other parts of the machine. In another example, each of the plurality of rotary hooks may be driven by a gearbox system.

In another example, the rotary hook(s) may be rotated in reverse by rotating the motor driving other parts of the machine in reverse (e.g., via use of a DC motor).

While a number of embodiments of the present invention have been described, it is understood that these embodiments are illustrative only, and not restrictive, and that many modifications may become apparent to those of ordinary skill in the art. For example, the present invention may be used to make any desired product (e.g., bedcovers). Further, while the present invention has been described primarily in connection with a lock stitch, the present invention may be utilized to make other types of stitches. Further still, the present invention may be used in the context of a computer-controlled system and/or process. Further still, any method steps may be carried out in any desired order (and any desired steps may be added and/or any desired steps may be eliminated).

What is claimed is:

1. A method of cutting thread, comprising:

rotating through an angle of greater than 360 degrees a rotary hook assembly to make a lock stitch formed by a top thread and a bottom thread, wherein at least one component is attached to or integral with the rotary hook assembly and wherein the component rotates with the rotary hook assembly;

separating a first portion of the top thread from a second portion of the top thread using the component; and rotating the rotary hook assembly in a reverse direction so as to cut the top thread and the bottom thread with a cutting blade contacted to at least a part of a surface of the component;

wherein the component comprises a thread guard.

2. The method of claim 1, further comprising stopping the rotation through an angle of greater than 360 degrees of the rotary hook assembly and then cutting.

3. The method of claim 1, wherein the cutting is done with the cutting blade and a cutting feature attached to or integral with the component.

* * * * *